US009290304B2

(12) United States Patent
Malcangio

(10) Patent No.: US 9,290,304 B2
(45) Date of Patent: Mar. 22, 2016

(54) DEVICE FOR PACKING BULK PRODUCTS, ESPECIALLY FOR FOOD

(76) Inventor: Domenico Malcangio, Piacenza (IT)

( * ) Notice: Subject to any disclaimer, the term of this patent is extended or adjusted under 35 U.S.C. 154(b) by 968 days.

(21) Appl. No.: 13/394,902

(22) PCT Filed: Aug. 12, 2010

(86) PCT No.: PCT/IB2010/053653

§ 371 (c)(1),
(2), (4) Date: Apr. 12, 2012

(87) PCT Pub. No.: WO2011/030244

PCT Pub. Date: Mar. 17, 2011

(65) Prior Publication Data

US 2012/0186198 A1 Jul. 26, 2012

(30) Foreign Application Priority Data

Sep. 9, 2009 (IT) ..... MI2009A1548
Apr. 16, 2010 (WO) ..... PCT/IB2010/051676

(51) Int. Cl.

| | |
|---|---|
| ***B65B 3/02*** | (2006.01) |
| ***B65B 31/00*** | (2006.01) |
| ***B65D 33/02*** | (2006.01) |
| ***B31B 19/74*** | (2006.01) |
| ***B65B 25/02*** | (2006.01) |
| ***B65B 31/02*** | (2006.01) |
| ***B65B 31/04*** | (2006.01) |
| ***B65D 81/20*** | (2006.01) |

(52) U.S. Cl.

CPC ..... *B65D 33/02* (2013.01); *B31B 19/74* (2013.01); *B65B 25/02* (2013.01); *B65B 31/024* (2013.01); *B65B 31/04* (2013.01); *B65D 81/2015* (2013.01); *B31B 2219/23* (2013.01); *B31B 2221/05* (2013.01); *B31B 2221/10* (2013.01)

(58) Field of Classification Search

USPC ..... 229/117.27, 164.2, 117.3, 117.34, 229/125.34

See application file for complete search history.

(56) References Cited

U.S. PATENT DOCUMENTS

| | | | | |
|---|---|---|---|---|
| 2,428,440 | A | 10/1947 | Waters | |
| 3,425,324 | A | 2/1969 | Becker et al. | |
| 3,561,667 | A * | 2/1971 | Saltman | 229/117.32 |
| 5,037,002 | A | 8/1991 | Tschanen | |
| 6,736,289 | B2 * | 5/2004 | Cook et al. | 222/105 |
| 2005/0017011 | A1 * | 1/2005 | Andrews, Sr. | 220/495.06 |

FOREIGN PATENT DOCUMENTS

| | | |
|---|---|---|
| EP | 0 122 864 | 10/1984 |
| GB | 1 022 538 | 3/1966 |
| GB | 2 410 736 | 8/2005 |

OTHER PUBLICATIONS

International Search Report dated Apr. 28, 2011, corresponding to PCT/IB2010/053653.

* cited by examiner

*Primary Examiner* — Christopher Demeree
(74) *Attorney, Agent, or Firm* — Young & Thompson

(57) ABSTRACT

A packaging device (1) for bulk goods (3), particularly for use for foods such as coffee beans, cocoa beans, rice, spices and seeds in general, includes at least one vacuum bag (2) defining an open side (2*d*) for insertion of the bulk goods (3) therein and hermetically sealable at the open side (2*d*) subsequent to evacuation of the air contained therein.

14 Claims, 10 Drawing Sheets

DEVICE FOR PACKING BULK PRODUCTS, ESPECIALLY FOR FOOD

FIELD OF THE INVENTION

The present invention relates to a packaging device for bulk goods, particularly for use for foods such as coffee beans, cocoa beans, rice, spices and seeds in general, but also for bulk goods that can be liquefied and subsequently solidified such as cocoa or the like.

In the large scale distribution sector of bulk goods for use for foods deriving from harvests in plantations, such as the case of coffee beans, cocoa beans, rice, spices and seeds in general, it is known to transport and store these goods in jute or polyethylene sacks, which when filled can weigh up to a total of 70 kilograms.

These sacks are in turn loaded, generally by hand, into containers of 30 or 60 cubic meters to allow their transport from the plantation where the goods were harvested and bagged to the plant for small scale distribution or to the food plant where these goods are suitably processed.

These sacks of known type are not without problems, including the fact that the protection from possible external agents that they offer the goods contained therein is solely of mechanical type.

In fact, through the mesh of the jute fabric with which the sack is produced, the goods contained are able to interact with the environment outside the sack and can therefore be subject to moisture exchange, modifying the values of hygroscopic equilibrium of these goods with consequent proliferation of moulds and modification of the organoleptic properties, as in the case of cocoa beans.

To overcome this problem, to which the poor hygiene of jute sacks must be added, according to prior art sacks with interiors made of plastic material are used and, once filled, a vacuum is created before they are sealed.

Notwithstanding the fact that in this way it is possible to isolate the goods contained from the external environment, sacks made of plastic material, above all during the loading and unloading steps of the container or in any case during the storage and transport steps, can be easily subject to damages which lead to perforation of these sacks or to loss of isolation of the goods contained from the external environment.

Another drawback of sacks of known type, whether made of jute or of plastic material, consists in the fact that they have a shape that is somewhat difficult to handle.

More precisely, as they do not have a predetermined shape that is ergonomically easy to grasp, but an undefined shape that depends on the internal position of the goods contained, sacks of known type are not easily handled by auxiliary mechanical systems, forcing the operator to handle each sack manually, which leads to non compliance with applicable regulations inherent to safety at work.

In fact, as sacks of known type reach an approximate weight of 70 kilograms when filled, operators are required to lift heavy loads which can cause repetitive strains that may endanger their physical health.

Moreover, manual handling of sacks of this weight cause operators lifting and carrying these sacks to work with very unstable balance and consequently in somewhat unsafe working conditions.

Another problem of sacks of known type consists in the fact that stacking thereof inside a storeroom or container leads to a waste of space, as the stacked sacks do not have a shape suitable for optimal storage thereof.

More precisely, sacks of known type occupy a substantially parallelepiped space but, as they have rounded corners, they do not fill it completely.

In order to optimize storage of sacks of known type, according to prior art, above all for sacks of small size such as those containing grains of rice to be stored on the retailers' shelves, the sack is inserted into a parallelepiped shaped box, typically made of cardboard. However, this solution does not solve the waste of space linked to the difference between the volume occupied and the effective volume of the goods contained as in order to facilitate insertion of the full sack into the box and as the shape of this sack is somewhat random, this latter is inserted with clearance inside the box.

Moreover, in the case in which these boxes containing the sacks are stacked on top of one another, the weight of the upper boxes leads to breakage of the lower boxes as the cardboard walls thereof support all the weight.

Still in this sector, it is known to transport goods that are liquefied, resolidified with a desired shape, for example substantially parallelepiped in shape, which are then inserted into a plastic sack of known type such as those described above.

Also in this case the sack is then inserted into a parallelepiped shaped box.

In detail, to shape the bulk goods these are poured in liquid state into substantially parallelepiped shaped moulds which are then cooled until complete solidification.

To allow subsequent extraction of the goods, said moulds must have sloping lateral edges, in practice the mould, and the goods that solidify therein, are substantially truncated pyramidal in shape.

Also in this case, there is a waste of space linked to the difference between the volume occupied by the box (in the shape of a regular parallelepiped) and the effective volume of the goods contained in the plastic sack.

The principal task of the present invention consists in the production of a packaging device for bulk goods, particularly for use for foods such as coffee beans, cocoa beans, rice, spices and seeds in general, but also for bulk goods that can be liquefied and subsequently solidified such as cocoa or the like, which solves the problems of prior art.

Within the scope of this task, an object of the invention consists in the production of a packaging device for bulk goods which is particularly advantageous with respect to prior art from a structural, functional and technical-economic point of view.

Another object of the present invention consists in the production of a packaging device for bulk goods which is structurally simple with limited production costs.

SUMMARY OF THE INVENTION

This task, and these and other objects which will be more apparent below, are achieved by a packaging device for bulk goods, particularly for use for foods such as coffee beans, cocoa beans, rice, spices and seeds in general, comprising at least one vacuum bag defining an open side for insertion of said bulk goods therein and hermetically sealable at said open side subsequent to evacuation of the air contained therein, characterized in that said packaging device comprises at least one sheet-like element made of a material substantially more rigid than the material of said at least one vacuum bag, fastened to the external surface of said at least one vacuum bag and defining portions which can be positioned transversely with respect to one another following consequent deformation of said at least one vacuum bag in a manner such that said at least one sheet-like element has portions maintained transverse to one another in the presence of a vacuum pressure produced inside said at least one vacuum bag.

BRIEF DESCRIPTION OF THE DRAWING

Further characteristics and advantages of the present invention will be apparent from the description of a preferred, but not exclusive, embodiment of a packaging device for bulk goods, particularly for use for foods such as coffee beans, cocoa beans, rice, spices and seeds in general, according to the invention, shown by way of non-limiting example in the accompanying drawings, wherein.

DETAILED DESCRIPTION OF THE INVENTION

Figure 1:
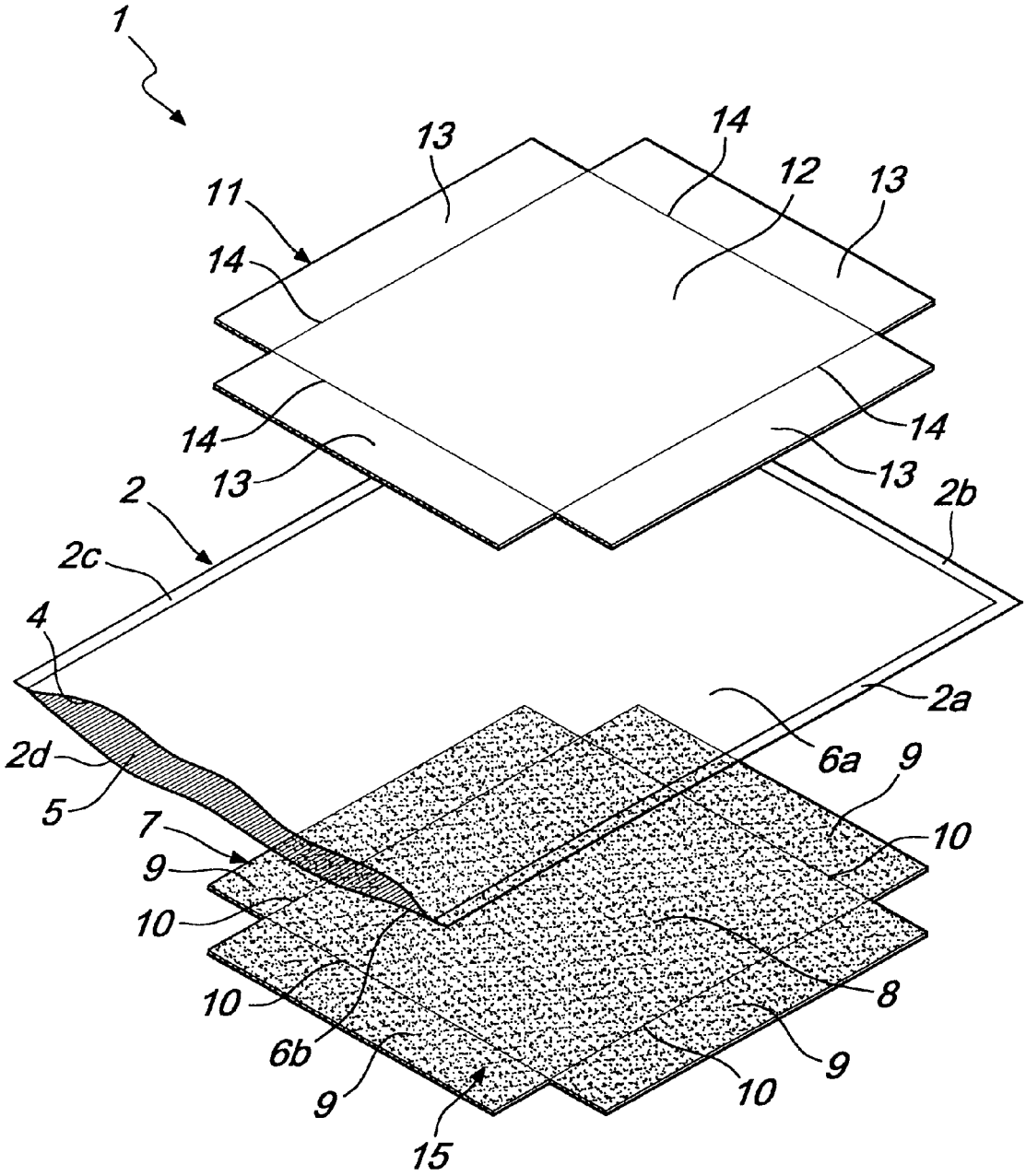
FIG. 1 is a perspective exploded view of the packaging device for bulk goods, according to the present invention, in a first embodiment.
Figure 2:
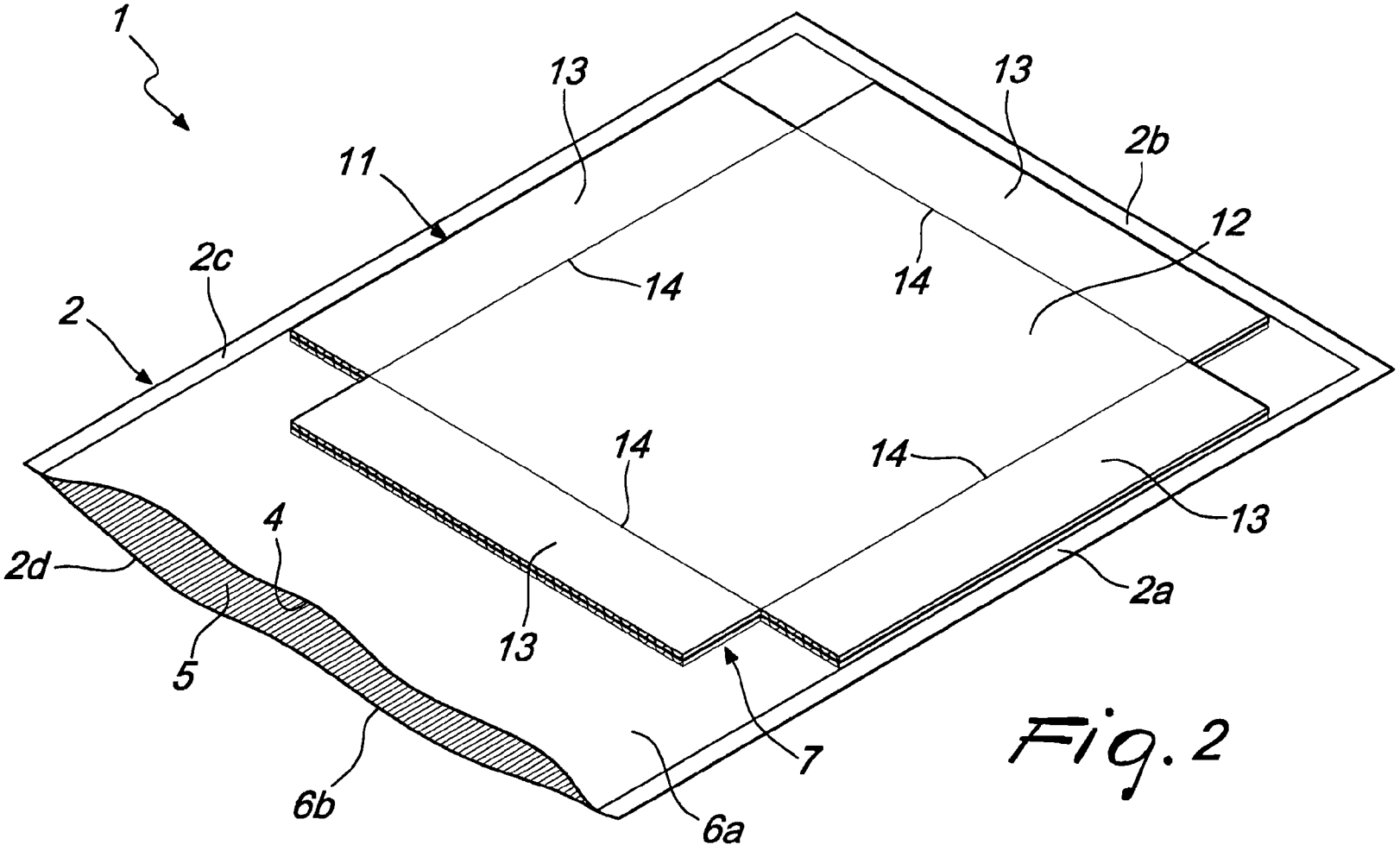
FIG. 2 is a perspective view of the packaging device for bulk goods of FIG. 1, according to the present invention, before the insertion step of the bulk goods.
Figure 3:
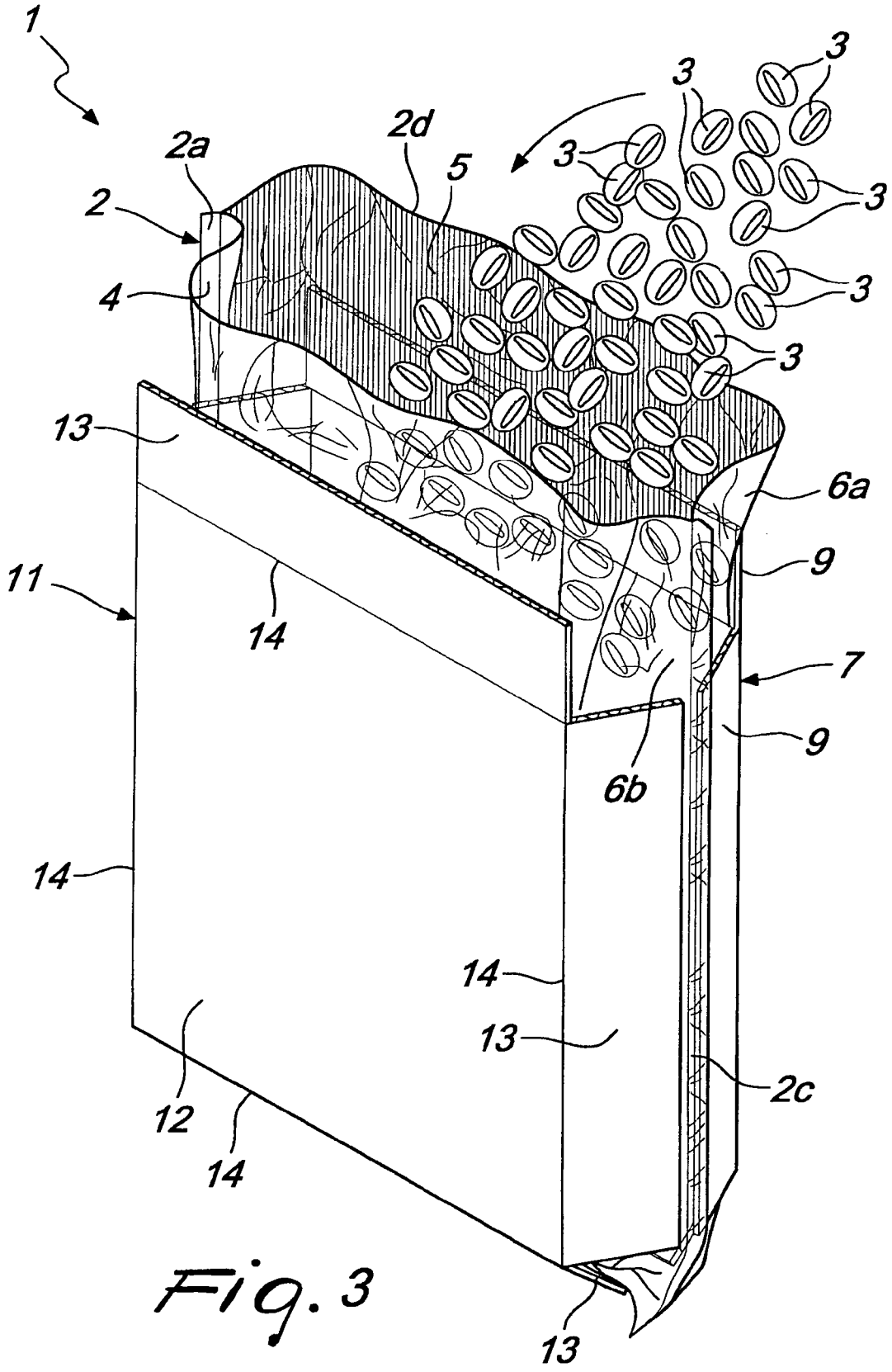
FIG. 3 is a perspective view of the packaging device for bulk goods of FIG. 1, according to the present invention, during the insertion step of the bulk goods.
Figure 4:
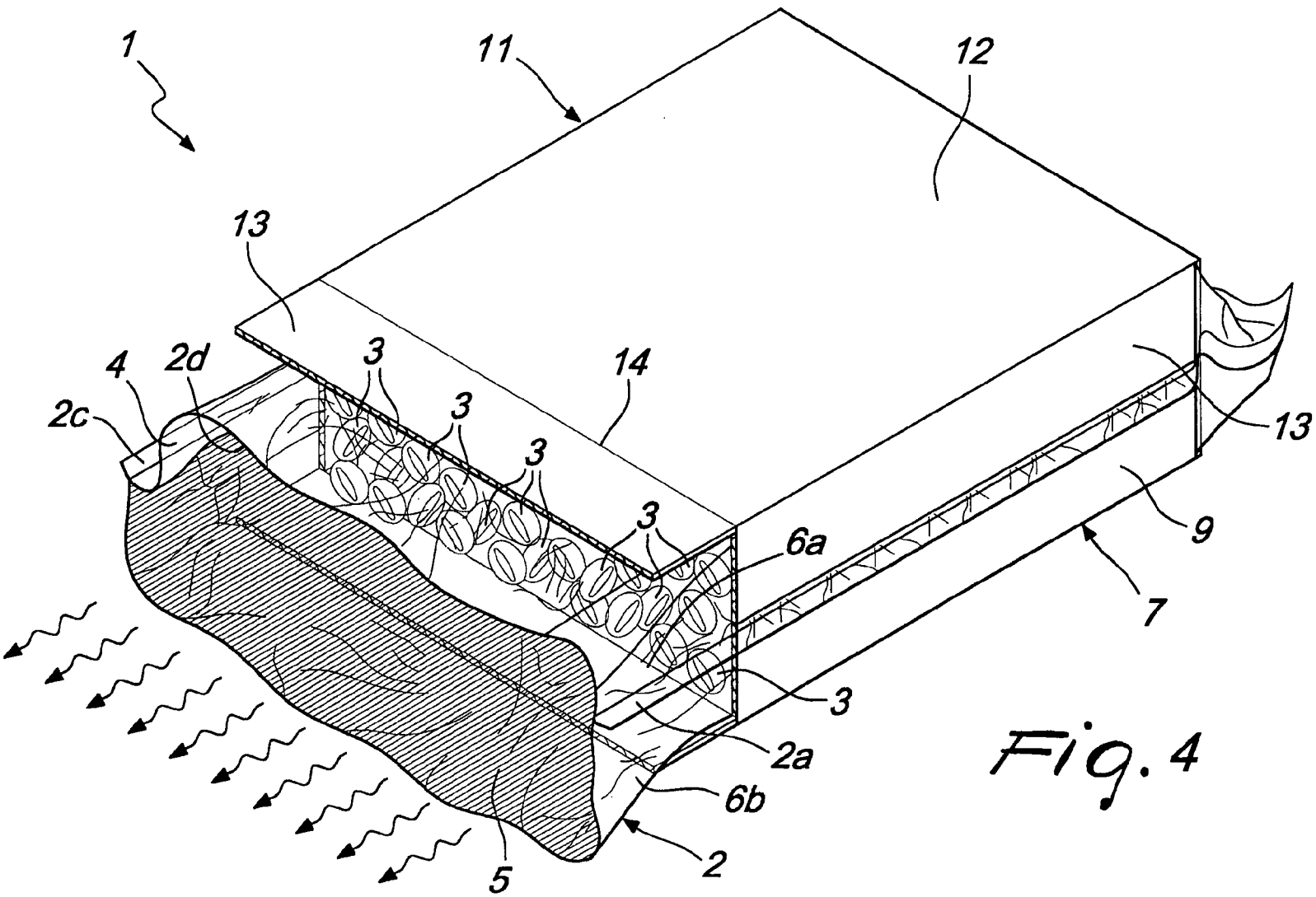
FIG. 4 is a perspective view of the packaging device for bulk goods of FIG. 1, according to the present invention, during the evacuation step of the air contained in the vacuum bag.
Figure 5:
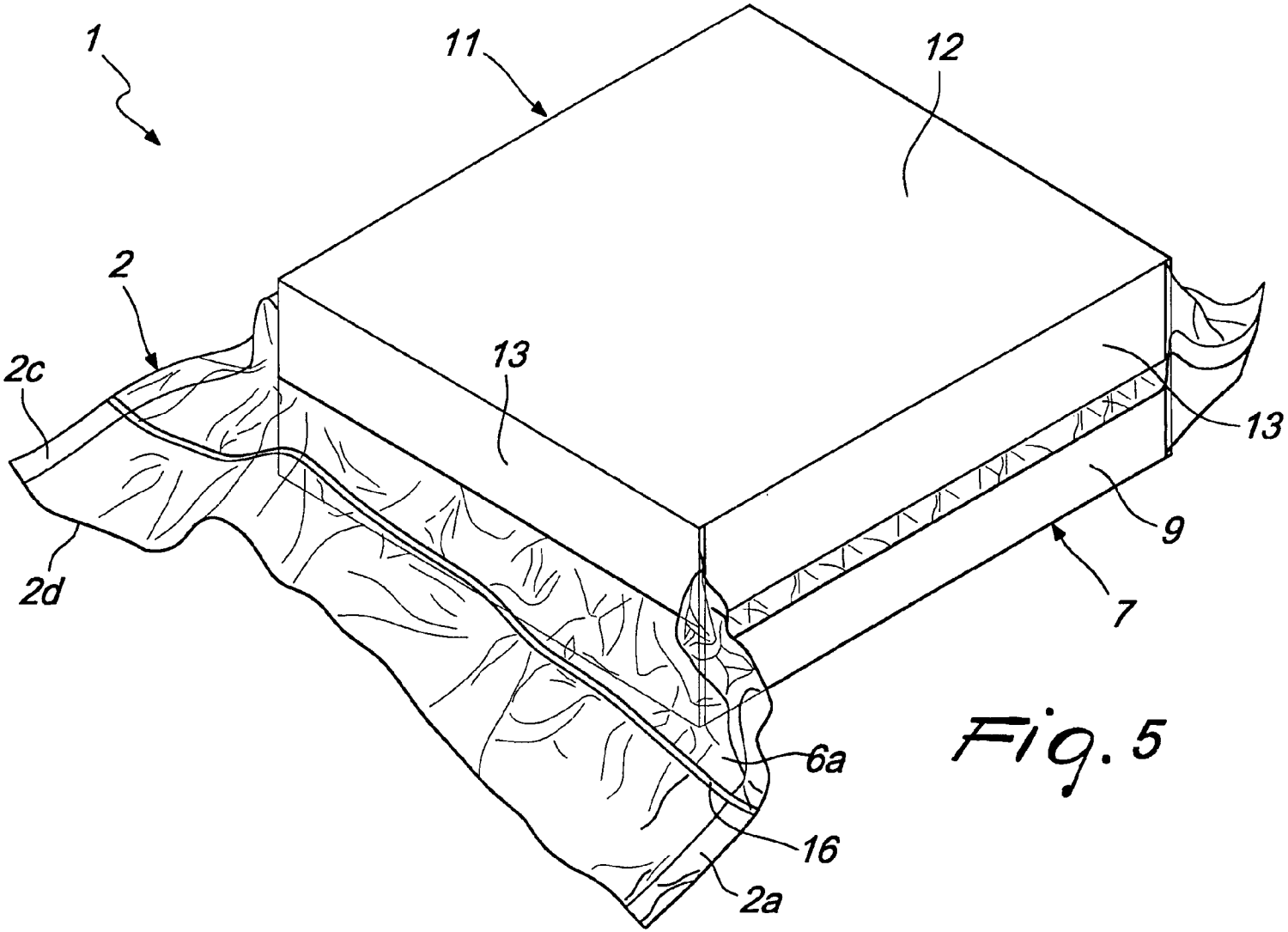
FIG. 5 is a perspective view of the packaging device for bulk goods of FIG. 1, according to the present invention, containing the bulk goods and sealed.

With reference to FIGS. 1 to 5, the packaging device for bulk goods, particularly for use for foods such as coffee beans, cocoa beans, rice, spices and seeds in general, indicated as a whole with the reference number 1, comprises at least one vacuum bag 2 substantially flat and rectangular in shape having three sides 2*a*, 2*b* and 2*c* closed with continuity and one open side 2*d* for the insertion of bulk goods 3 therein.

In more detail, the vacuum bag 2 can be produced by two sheets of heat-sealable plastic material, optionally transparent, rectangular in shape whose mutually facing faces 4 and 5 are, respectively, one smooth and one embossed to define channels for passage of the air necessary to form the vacuum.

The two sheets of plastic material are superimposed on one another and the corresponding sides are heat sealed to one another, except for one side to define the open side 2*d* of the vacuum bag 2.

As will be described in greater detail below, the vacuum bag 2 is hermetically sealable, by means of a heat sealing process, at the open side 2*d*, subsequent to evacuation of the air contained therein.

According to the invention, the packaging device 1 comprises at least one sheet-like element made of a material, such as cardboard, substantially more rigid than the material with which the vacuum bag 2 is made.

According to a first embodiment, two sheet-like elements 8 and 12, separate from one another, can be provided.

These sheet-like elements are fastened to the outer surface 6 of the vacuum bag 2 and can be placed transversely with respect to one another following filling of the vacuum bag 2 with the bulk goods 3 and following consequent deformation of the vacuum bag 2 in a manner such that sheet-like elements are maintained transverse to one another in the presence of a vacuum pressure produced inside the vacuum bag 2 during the evacuation step and maintained once the vacuum bag 2 is sealed.

In more detail, the packaging device 1 comprises a first cardboard template 7 defining a first sheet-like element 8 and a plurality of second sheet-like elements 9, respectively substantially polygonal in shape and substantially rectangular in shape and fastened to the outer surface 6 of the vacuum bag 2.

More precisely, a second sheet-like element 9 is provided for each side 10 of the first sheet-like element 8.

Advantageously, the first sheet-like element 8 is also substantially rectangular in shape and the second sheet-like elements 9 extend from the first sheet-like element 8 at the sides 10 of the first sheet-like element 8.

On the opposite side to the first cardboard template 7, on the outer surface 6, there is provided a second cardboard template 11, defining a third sheet-like element 12, of a shape substantially corresponding to the shape of the first sheet-like element 8, and a plurality of fourth sheet-like elements 13, also substantially rectangular in shape.

More precisely, there is provided a fourth sheet-like element 13 for each side 14 of the third sheet-like element 12.

Advantageously, the fourth sheet-like elements 13 extend from the third sheet-like element 12 at the sides 14 of the third sheet-like element 8.

As will be described in more detail below, the second sheet-like elements 9 and the fourth sheet-like elements 13 extend, respectively, from the first sheet-like element 8 and from the third sheet-like element 12 for a length substantially constant and equal to or less than half of the thickness of the packaging device 1, to prevent overlapping of the flaps and make it possible to vary the useful volume of the container once filled and sealed.

In the present embodiment, the outer surface of the packaging device 1 is thus formed by two cardboard templates 7 and 11 both substantially in the form of a cross whose appendices, previously referred to as second sheet-like elements 9 and fourth sheet-like elements 13, are folded with respect to the central portion of the respective cardboard template 7 or 11, i.e. respectively with respect to the first sheet-like element 8 and to the third sheet-like element 12, in a manner such as to be positioned substantially perpendicular with respect to the first sheet-like element 8 and to the third sheet-like element 12.

In this manner, the packaging device 1 assumes a substantially parallelepiped shape whose lateral faces are defined, respectively, by the first sheet-like element 8, by the third sheet-like element 12 and by joining of the second sheet-like elements 9 with the fourth sheet-like elements 13.

More precisely, the first sheet-like element 8 defines the front face of the packaging device 1, the third sheet-like element 12 defines the rear face of the packaging device 1, opposite the front face, and the second sheet-like elements 9 with the fourth sheet-like elements 13 define the four lateral faces.

Preferably, said sheet-like elements have at least one face, and more precisely the outer face, with a surface that is knurled, corrugated or in any case not perfectly smooth. For example, said surface can present a series of lines that form the same number of crests and valleys of dimensions compatible with the thickness of the sheet-like element.

In particular, if said sheet-like element is made of cardboard, said knurling is formed by the actual layer of corrugated paper material which is used to give rigidity to the cardboard. The presence of the outer surface thus produced is useful both to facilitate grasping and handling of packages by operators, but also to facilitate friction between one package and another when these are stacked and stored.

In a possible variant of the packaging device 1, the second cardboard template 11 can be without the fourth sheet-like elements 13. In this way, the lateral faces of the packaging device 1 are defined solely by the second sheet-like elements 9 which extend for a length substantially constant and equal to or less than the thickness of the packaging device 1 once filled and sealed.

Although the parallelepiped shape of the packaging device 1 is the optimal shape to allow optimal stacking and storage of the packaging devices 1, by changing the shape of the first sheet-like element 8 and of the third sheet-like element 12, the packaging device 1 can assume any prismatic shape with polygonal base.

Advantageously, in order to use less material and in order to obtain cardboard templates with simpler shapes than those proposed, in any case achieving the task and objects set, in a possible variant of the packaging device 1, according to the present invention, in addition to the first sheet-like element 8, there can be provided at least one second sheet-like element 9, not necessarily in once piece with the first sheet-like element 8 and positioned on the outer surfaces 6*a* and 6*b* in proximity to at least one of the sides 10 of the first sheet-like element 8.

In this manner, the packaging device 1 in any case assumes a substantially parallelepiped shape or, more generally, depending on the shape of the first sheet-like element 8, a substantially prismatic shape with polygonal base having a front face and a single lateral face defined, respectively, by the first sheet-like element 8 and by the second sheet-like element 9.

Proceeding with this philosophy, i.e. by varying the number of the second sheet-like elements 9 and the number of the fourth sheet-like elements 13 with respect to the number of the sides of the first and of the third sheet-like element 8 and 12 and by varying the length of extension, it is possible to obtain a plurality of variants of the packaging device 1 all falling within the scope of the inventive concept of the present invention.

Figure 9:
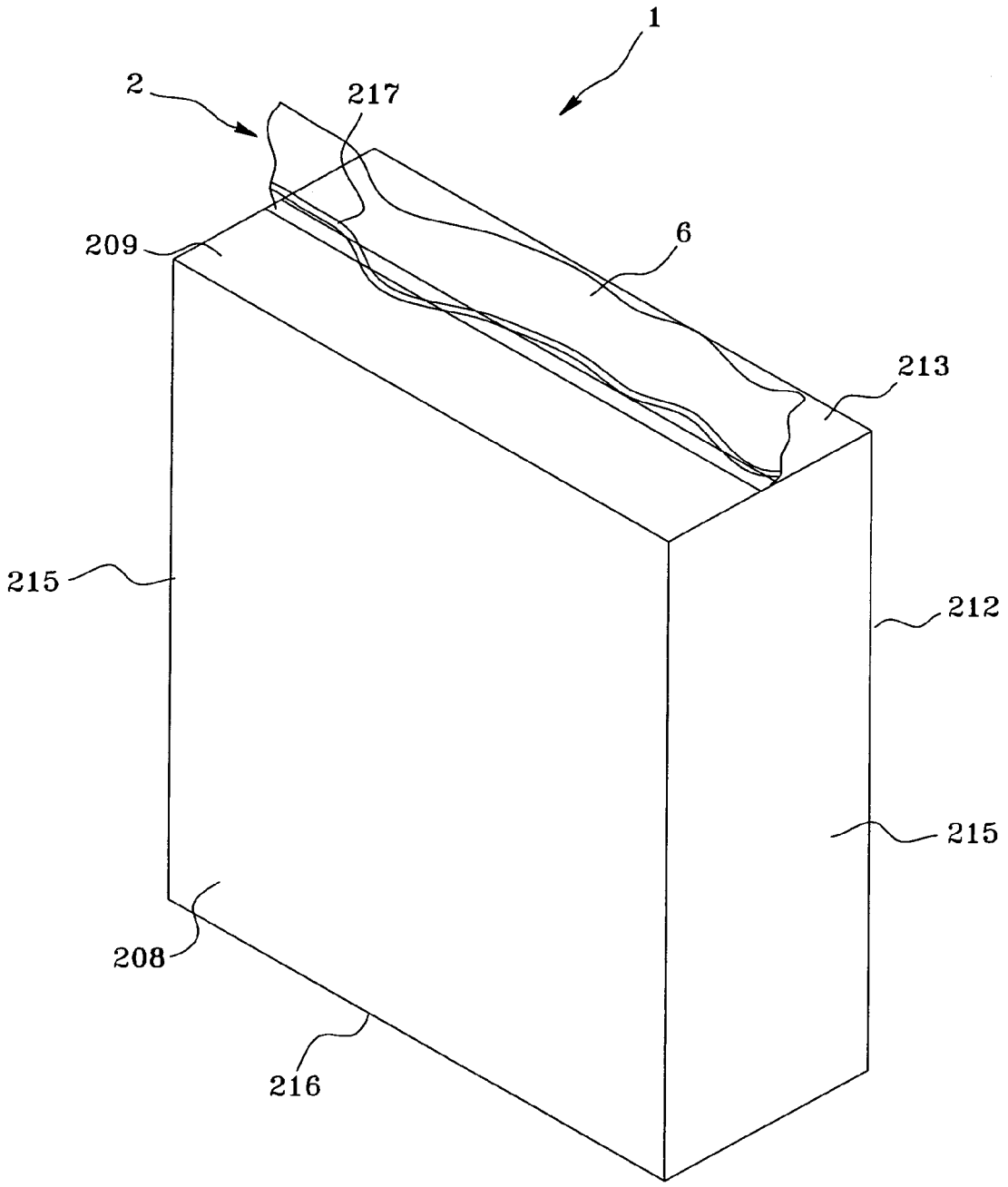
FIG. 9 is a perspective view of the packaging device for bulk goods of FIG. 6, according to the present invention, containing the bulk goods and sealed.

With particular reference to FIG. 9, the production process of the packaging device 1 for bulk goods 3, particularly for use for foods such as coffee beans, cocoa beans, rice, spices and seeds in general, indicated as a whole with the reference number 100, comprises the steps described below.

A first step provides for a first punching step 101 of the first cardboard template 7 defining the first sheet-like element 8 and the second sheet-like elements 12.

In this first punching step 101, fold lines are traced between the first sheet-like element 8 and the second sheet-like elements 12, at the sides 10, necessary in order to allow transverse positioning with respect to one another.

Subsequently or simultaneously to the first punching step 101, there is provided a second punching step 102 of the second cardboard template 11 defining the third sheet-like element 12 and the fourth sheet-like elements 13; optionally the first and second template can be in one piece and folded to define the various sheet-like elements.

In this second punching step 102, just as in the first punching step 101, fold lines are traced between the third sheet-like element 12 and the fourth sheet-like elements 13, at the sides 14, necessary in order to allow transverse positioning with respect to one another.

Once the cardboard templates 7 and 11 have been produced, these are fastened to the vacuum bag 2 by means of a superimposing step 105 during which the first cardboard template 7 and the second cardboard template 11, with the vacuum bag 2 interposed, are joined to the bag.

This fastening is made possible by means of a first depositing step 103 of liquid glue 15 between a first face of the first cardboard template and the bag 2 and by means of a second depositing step 104 of glue 15 between a second face of the second cardboard template 11 and the bag; the glue can be applied, depending on the various production needs, to one of the surfaces to be joined. This depositing of glue 15 can be produced with a system of rollers, known and therefore not described in detail.

Conveniently, during the superimposing step 105 the first face of the first cardboard template 7 and the second face of the second cardboard template 11 with the liquid glue 15 spread thereon are mutually facing.

After assembly of the three parts of the packaging device 1, i.e. the two cardboard templates 7 and 11 and the vacuum bag 2, the filling step 106 of the vacuum bag 2 with bulk goods 3 can take place.

In this step, as a result of the thrust exerted by the bulk goods 3, the vacuum bag 2 is deformed positioning the second sheet-like elements 9 transversely with respect to the first sheet-like element 8 and the fourth sheet-like elements 13 transversely with respect to the third sheet-like element 12.

Subsequently, after the vacuum bag 2 has been completely filled, the evacuation step 107 is performed, during which the air contained in the vacuum bag 2 is evacuated to produce a vacuum pressure inside the vacuum bag 2 in a manner such that the second sheet-like elements 9 and the fourth sheet-like elements 13 are maintained transverse, respectively, with respect to the first sheet-like element 8 and the third sheet-like element 12, so as to define the parallelepiped shape of the packaging device 1.

Finally, a sealing step 108 is performed, as a result of which, by means of a heat-sealing process, the vacuum bag 2 containing said bulk goods 3 is sealed with a weld 16 so as to maintain over time the internal vacuum pressure and isolation of the bulk goods 3 from the external environment.

According to a further embodiment of the invention, the packaging device can be obtained from a single element folded over itself, and suitably welded, to produce a package substantially parallelepiped in shape.

Figure 6:
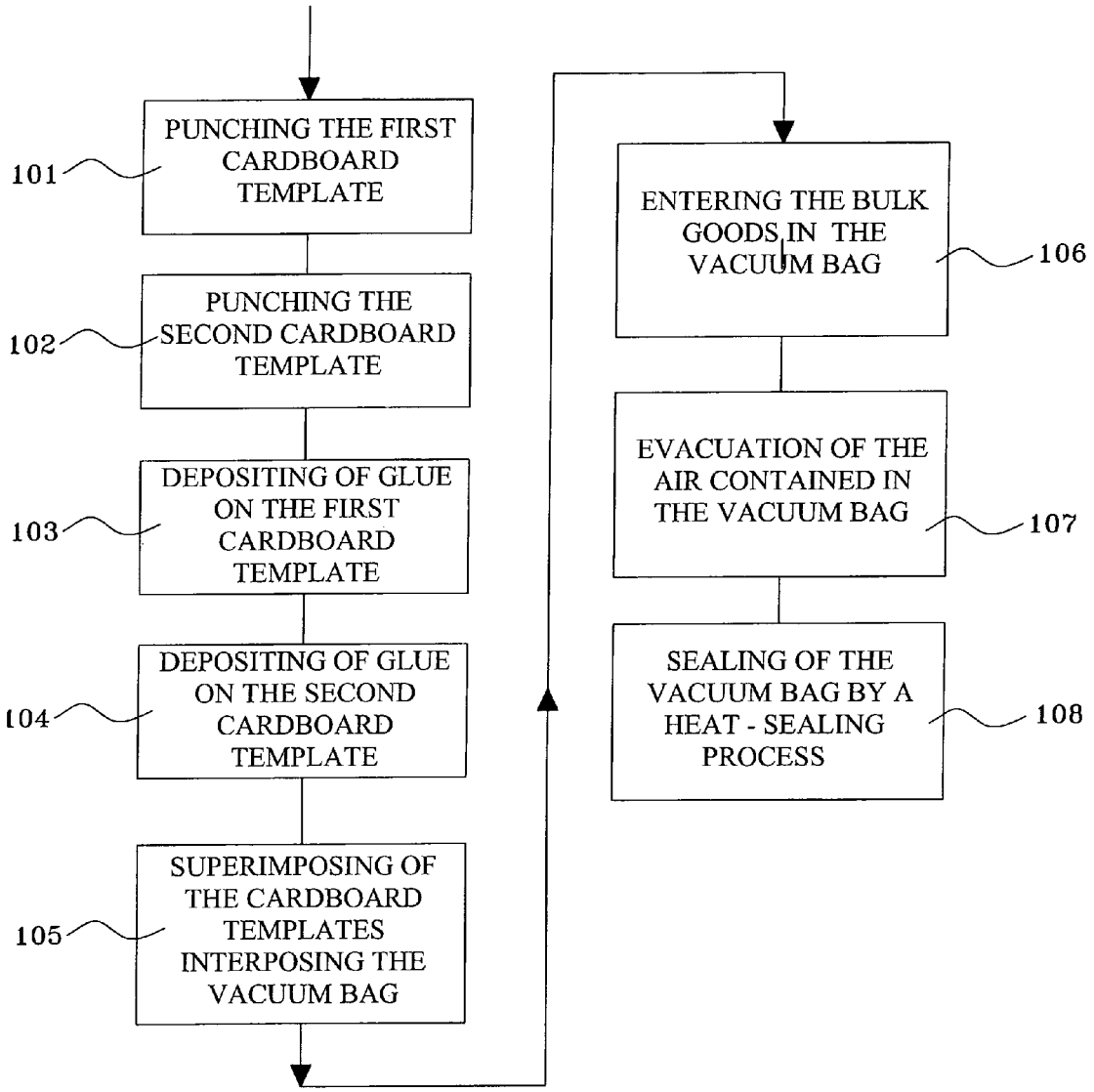
FIG. 6 is a block diagram representing the production process of the packaging device for bulk goods, according to the present invention.
Figure 7:
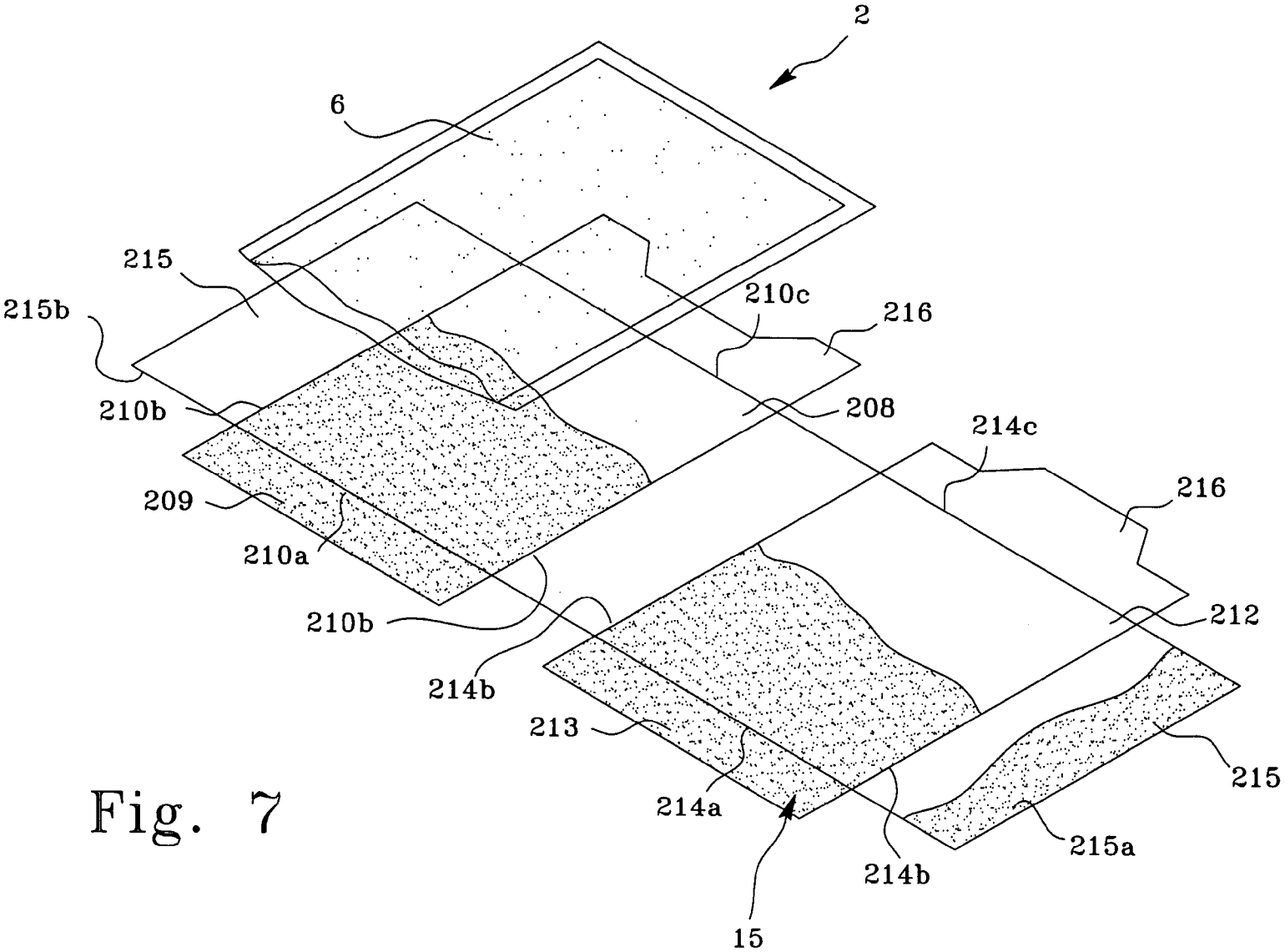
FIG. 7 is an exploded perspective view of the packaging device for bulk goods, according to the present invention, in a further embodiment.
Figure 8:
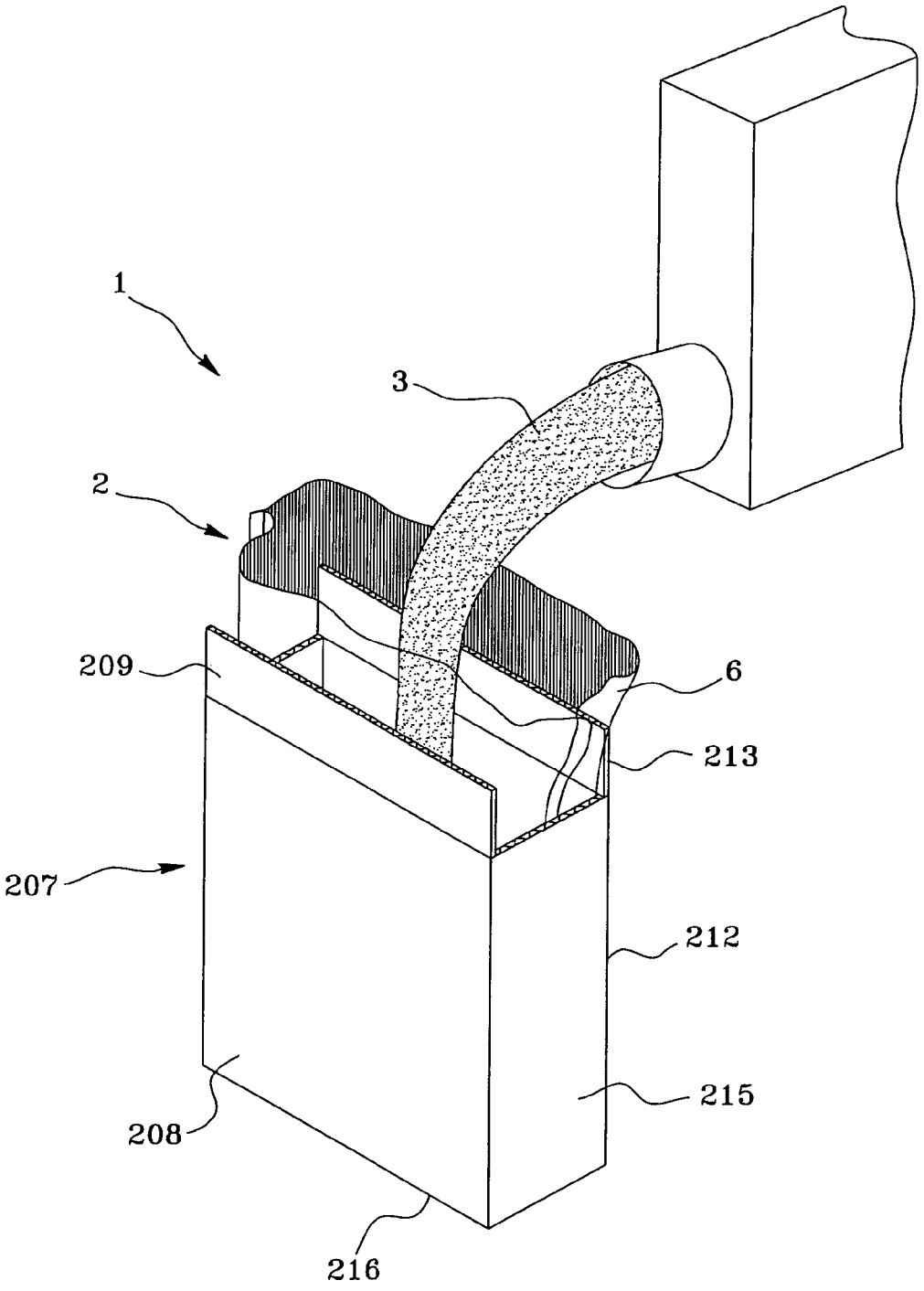
FIG. 8 is a perspective view of the packaging device for bulk goods of FIG. 6, according to the present invention, before the insertion step of the bulk goods.

In more detail, with reference to FIGS. 6 to 8, the packaging device 1 comprises a cardboard template 207 defining at least one first sheet-like element 208, one second sheet-like element 209, one third sheet-like element 212, one fourth sheet-like element 213, respectively substantially polygonal and substantially rectangular in shape and fastened to the outer surface 6 of the vacuum bag 2.

More precisely, said second sheet-like element 209 is provided at one edge 210*a* of the first sheet-like element 208 and said fourth sheet-like element 213 is provided at one side 214*a* of said second sheet-like element 212.

More in detail, fifth sheet-like elements 215 and sixth sheet-like elements 216 are also provided.

Said fifth sheet-like elements 215 are provided at the edges 210*b* and 214*b*, respectively of the first and of the third sheet-like elements 208 and 212.

The sheet-like elements 116 are instead provided at the edges 210*c* and 214*c* respectively of the first and of the third sheet-like element 208 and 212.

In particular, said fifth sheet-like elements 215 extend, respectively, from the first sheet-like element 208 and from the third sheet-like element 212 for a length substantially constant and equal to the thickness of the packaging device 1.

The second and the fourth sheet-like element 209 and 213 instead extend, respectively, from the first sheet-like element 208 and from the third sheet-like element 212 for a length substantially constant and equal to or less than half the thickness of the packaging device 1, to avoid overlapping of the flaps.

The sixth sheet-like elements 216 positioned at the edges 210*c* and 214*c* of the first and of the second sheet-like element, can be shaped in a manner such as to be interlocked, once the cardboard template 207 is folded to form the package 1, to make the bottom of said package 1 solid, as shown in the figure.

In the present embodiment, the outer surface of the packaging device 1 is therefore formed by a cardboard template 207 whose appendices, previously referred to as sheet-like elements 209, 213, 215 and 216, are folded with respect to the first sheet-like element 208 and to the third sheet-like element 212, in a manner such as to be positioned substantially perpendicular with respect to said first sheet-like element 208 and to said third sheet-like element 212.

In this way, the packaging device 1 assumes a substantially parallelepiped shape, whose lateral faces are defined, respectively, by the first sheet-like element 208, by the third sheet-like element 212 and by the sheet-like elements 209, 213, 215 and 216.

More precisely, the first sheet-like element 208 defines the front face of the packaging device 1, the third sheet-like element 212 defines the rear face of the packaging device 1, opposite the front face, the second and the fourth sheet-like element 209 and 213 define the upper face of the package 1, the fifth sheet-like elements 215 define the lateral faces of the package 1 and the sixth sheet-like elements 216 define the lower face of the package.

Unlike the first embodiment, where all the sheet-like elements were constrained to the outer surface 6 of the bag 2, in this second embodiment said bag 2 is fastened to the first sheet-like element 208, to the third sheet-like element 212 and to the second and fourth sheet-like element 209 and 213.

More precisely, the bag 2 is fastened only partially to the first and to the third sheet-like element 208 and 212, and preferably in the upper portion, i.e. towards the opening of the package (as shown in the figure).

This second embodiment is particularly advantageous in the case in which the bulk goods are goods that can be liquefied and subsequently solidified, such as cocoa or the like, as will be better described below.

Figure 10:
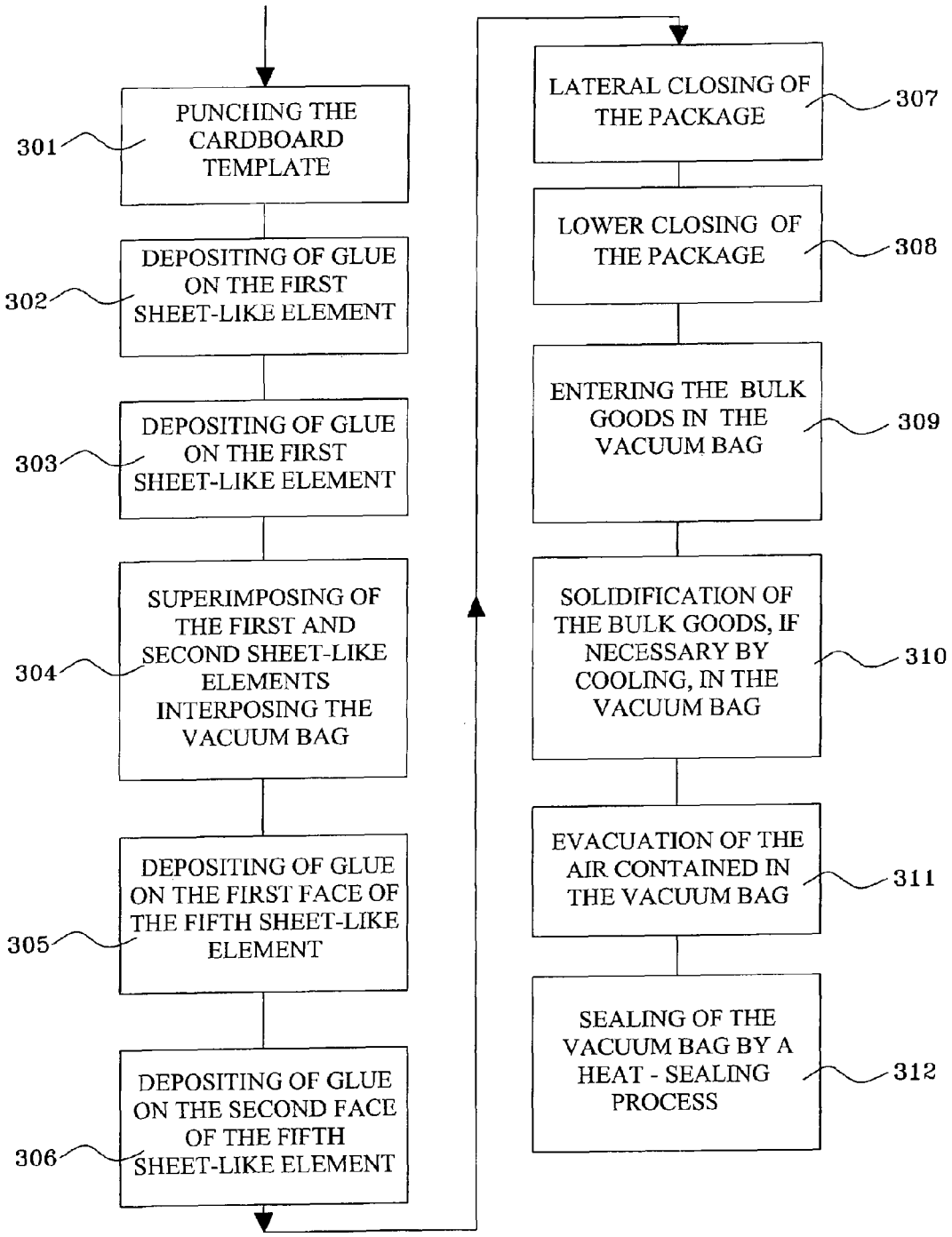
FIG. 10 is a block diagram representing the production process of the packaging device for bulk goods, according to a further embodiment.

With particular reference to FIG. 10, the production process of the packaging device 1 for bulk goods 3, and in particular bulk goods that can be liquefied and subsequently solidified like cocoa or the like, comprises the steps described below.

A first step provides for a first punching step 301 of the cardboard template 207 defining all the sheet-like elements 208, 209, 212, 213, 215 and 216.

In this first punching step 301, fold lines are traced between the various sheet-like elements, necessary in order to allow transverse positioning with respect to one another.

Once the cardboard template 207 has been produced, it is fastened to the vacuum bag 2 by means of a superimposing step 304 during which the first sheet-like element 208 and the second sheet-like element 212, with the vacuum bag 2 interposed, are rotated until said sheet-like elements 208 and 212 are superimposed on and joined to the bag.

This fastening is made possible by means of a first depositing step 302 of liquid glue 15 between a first face of the first and of the second sheet-like elements 208 and 209, and the bag, and by means of a second depositing step 303 of glue 15 between a second face of the third and of the fourth sheet-like element 212 and 213, and the bag.

The glue can be applied, depending on the various production needs, to one of the surfaces to be joined.

This depositing of glue 15 can be produced with a system of rollers, known and therefore not described in detail.

After assembly of the two parts of the packaging device 1, i.e. the cardboard template 207 and the vacuum bag 2, the lateral closing step 307 of the package 1 can take place.

This closing is produced by means of a first depositing step 305 of glue 15 on a first face 215*a* of a fifth sheet-like element 215, positioned at the end of the cardboard template 207 and a second depositing step 306 of glue 15 on a second face 215*b* of a fifth sheet-like element 215 positioned at the opposite end of said cardboard template 207.

Closing is achieved by making the two faces 215*a* and 215*b* adhere so that they become integral Once the package has been closed laterally, the lower closing step 308 of the package 1 can take place.

To perform this operation the two appropriately shaped sheet-like elements 216 are taken to a transverse position with respect to the first and to the third sheet-like element 208 and 212, and interlocked.

The package therefore assumes the shape represented in FIG. 7, and is ready for the filling step 309 of the vacuum bag 2 with bulk goods in liquid state, such as cocoa or the like.

In this step, as a result of the thrust exerted by the liquid bulk goods 3, the vacuum bag 2 is deformed filling the whole of the inner volume of the package 1 defined by the folded cardboard template 207.

Subsequently, after the vacuum bag 2 has been filled completely, the solidification step 310 takes place, in which the liquefied bulk goods contained in the bag are left to solidify, if necessary by cooling the assembly.

After solidification has taken place the evacuation step 311 takes place, during which the air contained in the vacuum bag 2 containing the bulk goods 3 is evacuated to produce a vacuum pressure inside the vacuum bag 2 in a manner such that the second sheet-like element 209 and the fourth sheet-like element 213 are maintained transverse, respectively, with respect to the first sheet-like element 208 and to the third sheet-like element 212 so as to define the final parallelepiped shape of the packaging device 1.

Finally, a sealing step 312 is performed, as a result of which, by means of a heat-sealing process, the vacuum bag 2 containing said solidified bulk goods 3 is sealed with a weld 217 so as to maintain over time the internal vacuum pressure and isolate the bulk goods 3 from the external environment.

In practice, it has been seen how the packaging device for bulk goods, particularly for use for foods such as coffee beans, cocoa beans, rice, spices and seeds in general, according to the present invention, fully achieves the task and the objects set, as it offers protection to the goods contained therein, from any external agents, both of mechanical and of chemical nature.

In fact, with vacuum sealing, the goods contained in the bag are unable to interact with the environment outside the bag and are therefore unable to exchange moisture, protecting the values of hygroscopic equilibrium of the goods with consequent elimination of deterioration linked to the proliferation of moulds and modification of the organoleptic properties.

The cardboard covering of at least part of the outer surface of the plastic bag allows it to be protected from any damage which could lead to the perforation of these bags, or to the loss of isolation of the goods contained from the external environment.

More precisely, the goods contained in the packaging device according to the invention are protected from environmental moisture at the time of packaging, from moisture present in the container during transport or in storerooms due to unavoidable condensate that develops as a result of the differences between the temperatures typical of the countries of origin of plantations and those of the colder seasons of consumer countries, from possible contamination caused by an occasionally contaminated environment, from sunlight and from oxidation in contact with air.

Another advantage of the packaging device for bulk goods according to the present invention consists in the fact that, being substantially parallelepiped in shape, they can be easily stacked and stored on pallets and shelves.

In particular, the stackable nature of the packaging devices for bulk goods, according to the present invention, allows each single device to have dimensions such that it has a weight of less than or at most equal to 25 kilograms, complying with applicable European regulations concerning safety at work.

In this way, it is possible to manually handle the single packaging devices on pallets or on racks without operators being subject to excessive strains and, at the same time, it is possible to handle high quantities of goods contained in a plurality of packaging devices stacked on top of one another on pallets easily managed with automated handling systems that aid operators.

Another advantage of the packaging device according to the present invention consists in the fact that the goods contained therein fill the whole volume defined by the packaging device eliminating all waste of space, for example inside storerooms or containers, linked to the shape that is not a perfect parallelepiped or to incomplete filling of prior art packaging devices.

In fact, with the packaging device according to the invention, the goods completely fill even the corners of the outer covering as there are no clearances between the vacuum bag and the outer cardboard covering.

In this way it is possible to transport more goods in the same space occupied by the packaging devices according to the invention compared to prior art, with obvious economic advantages.

Another advantage of the packaging device for bulk goods according to the present invention consists in the fact that as there are no empty spaces inside the packaging device, in the case of stacking a plurality of packaging devices, the weight of the upper packaging devices is discharged onto the goods contained in the lower packaging devices without leading to breakage of the cardboard walls of the lower packaging devices.

The packaging device for bulk goods, particularly for use for foods such as coffee beans, cocoa beans, rice, spices and seeds in general, but also for bulk goods that may be liquefied and subsequently solidified such as cocoa or the like, and the respective production process, according to the present invention, thus conceived are susceptible to numerous modifications and embodiments, all falling within the scope of the inventive concept.

Moreover, all parts can be substituted by other technically equivalent elements.

In practice, the materials used, providing they are compatible with the specific use, and the contingent dimensions and forms can be any, according to requirements and to the state of the art.

The invention claimed is:

1. A packaging device (1) for bulk goods (3), the packaging device comprising:

a vacuum bag (2) that is rectangular and substantially flat when unfilled and having three closed edges (2*a*, 2*b*, 2*c*) and one open edge (2*d*) with an opening extending from one of said three closed edges to another of said three closed edges, said opening being configured for insertion of the bulk goods (3) therein and to be hermetically sealed after insertion of the bulk goods and evacuation of air from the vacuum bag;

a first sheet-like element (8, 208) made of a material substantially more rigid than material of said vacuum bag (2), fastened to an external surface (6) of said vacuum bag (2), and defining portions which are positionable transversely with respect to one another following filling of said vacuum bag (2) with said bulk goods (3) and following consequent deformation of said vacuum bag (2); and a second sheet-like element (9, 209) fastened to the external surface (6) of said vacuum bag (2), wherein the second sheet-like element (9, 209) is maintained transverse with respect to the first sheet-like element (8, 208) so that the packaging device assumes a substantially parallelepiped shape in the presence of a vacuum pressure produced inside said vacuum bag (2), and wherein said second sheet-like element (9, 209) is arranged in proximity to the open edge (2*d*) of said vacuum bag (2) with the open edge (2*d*) of said vacuum bag (2) protruding beyond a distal edge of said second sheet-like element so that the opening is accessible beyond the distal edge for insertion of the bulk goods before being hermetically sealed.

2. The packaging device according to claim 1, wherein said first sheet-like element (8, 208) is substantially polygonal and said second sheet-like element (9, 209) is substantially rectangular, said second sheet-like element (9, 209) being positioned on said external surface (6) in proximity to an edge (10, 210*a*) of said first sheet-like element (8, 208).

3. The packaging device according to claim 2, further comprising a first cardboard template (7) defining both said first sheet-like element (8, 208) and said second sheet-like element (9, 209), said second sheet-like element (9, 209) extending from the edge (10, 210*a*) of said first sheet-like element.

4. The packaging device according to claim 3, further comprising a plurality of said second sheet-like element (9), extending from said first sheet-like element (8) at respective edges (10) of said first sheet-like element (8) and being fastened to said external surface (6).

5. The packaging device according to claim 1, further comprising a third sheet-like element (12, 212) of a shape substantially corresponding to said first sheet-like element (8, 208) fastened to said external surface (6) on an opposite side of said vacuum bag (2) from said first sheet-like element (8, 208), and a fourth sheet-like element (13, 213) substantially rectangular and fastened to said external surface (6) in proximity to an edge (14, 214*a*) of said third sheet-like element (12, 212), said vacuum bag being interposed between said first and third sheet-like elements.

6. The packaging device according to claim 5, wherein the first through fourth sheet-like elements (208, 209, 212, 213) are one piece.

7. The packaging device according to claim 5, further comprising a second cardboard template (11), defining both said third sheet-like element (12) and said fourth sheet-like element (13), said fourth sheet-like element (13) extending from said third sheet-like element (12) at the edge (14) of said third sheet-like element (12).

8. The packaging device according to claim 7, further comprising a plurality of said fourth sheet-like element (13) extending from said third sheet-like element (12) at respective edges (14) of said third sheet-like element (12) and fastened to said external surface (6).

9. The packaging device according to claim 5, wherein said first sheet-like element (8) and said third sheet-like element (12) are rectangular.

10. The packaging device according to claim 5, further comprising a cardboard template (207) defining said first through fourth sheet-like elements (208, 209, 212, 213), said second sheet-like element (209) extending from said first sheet-like element at an edge (210*a*) of said first sheet-like element (208), said fourth sheet-like element (213) extending from said third sheet-like element (212) at the edge (214*a*) of said third sheet-like element (212).

11. The packaging device according to claim 10, further comprising fifth sheet-like elements (215) extending from said first (208) and from said third (212) sheet-like element at respective edges (210*b*, 214*b*) thereof.

12. The packaging device according to claim 11, further comprising sixth sheet-like elements (216) extending from said first (208) and third (212) sheet-like elements at respective edges (210*c*, 214*c*) thereof.

13. The packaging device according to claim 12, wherein said sixth sheet-like elements (216) are shaped to be interlocked when the cardboard template (207) is folded to form the packaging device (1), to make the bottom of the packaging device (1) solid.

14. The packaging device according to claim 5, wherein said first through fourth sheet-like elements (8, 9, 12, 13, 208, 209, 212, 213) have at least one outer face with a surface that is not smooth.

* * * * *